US006085492A

United States Patent [19]

Möller et al.

[11] Patent Number: 6,085,492

[45] Date of Patent: Jul. 11, 2000

[54] METHOD FOR STERILIZING CLOSED CONTAINERS

[75] Inventors: Håkan Möller, Ystad; Michael Brändström, Malmö, both of Sweden

[73] Assignee: Tetra Laval Holdings & Finance S.A., Pully, Switzerland

[21] Appl. No.: 09/117,651

[22] PCT Filed: Feb. 7, 1997

[86] PCT No.: PCT/SE97/00182

§ 371 Date: Dec. 7, 1998

§ 102(e) Date: Dec. 7, 1998

[87] PCT Pub. No.: WO97/31826

PCT Pub. Date: Sep. 4, 1997

[30] Foreign Application Priority Data

Feb. 28, 1996 [SE] Sweden ..... 9600760

[51] Int. Cl.[7] ..... B65B 55/08

[52] U.S. Cl. ..... 53/426; 422/22

[58] Field of Search ..... 53/167, 425, 426; 422/21, 22, 23, 24

[56] References Cited

U.S. PATENT DOCUMENTS

| | | | |
|---|---|---|---|
| 3,832,827 | 9/1974 | Lemelson | 53/426 X |
| 4,714,595 | 12/1987 | Anthony et al. | 383/103 X |
| 4,866,282 | 9/1989 | Miripol et al. | 422/24 X |
| 4,896,768 | 1/1990 | Anderson | 53/425 X |
| 4,944,132 | 7/1990 | Carlsson et al. | 53/167 |

*Primary Examiner*—Daniel B. Moon
*Attorney, Agent, or Firm*—James Ray & Associates

[57] ABSTRACT

The invention relates to a method for sterilising a closed container (1) which is ready to be filled. The container is substantially in the form of a homogenous flat first sheet (2A) and a non-homogenous second sheet (2B) with susbtantially plane insides and with a space (14) between the first and the second sheet. A sterilisation of the insides of the container and the space (14) is achieved by means of electron exposure of the outside of the first sheet (2A).

4 Claims, 2 Drawing Sheets

2B
2A
13
1
3
4
10
5
11
12
6
14
13

METHOD FOR STERILIZING CLOSED CONTAINERS

BACKGROUND OF THE INVENTION

1. Field of the Invention

The present invention relates to a method for sterilizing a container which is ready to be filled. More specifically, the invention relates to a method for sterilizing a closed container which is ready to be filled, the container being in the form of a homogenous flat first board and a non-homogenous second board with substantially plane insides and having a space between the first and the second board.

2. Description of the Related Art

It has for a long time within the industry for packaging of foods been a need for a fast method for sterilizing a package material without using chemicals. Furthermore, it would often be of great importance if a sterilizing equipment could be avoided in the actual filling machines, i.e. that the containers could be sterilized in advance in connection with the manufacturing of the material. If premanufactured containers were accessible in large numbers at different places for filling of foods in filling machines, these machines could then be manufactured at a lower price and the investment costs would be lower since certain precautions for aseptic filling probably could be minimized. In addition, such machines can result in lower operational costs which by itself is not a minor advantage.

Package materials are presently sterilized by a treatment with steam, steam/condensation or hydrogen peroxide. Depending on the type of package material the inside of a container can be sterilized with hydrogen peroxide, in liquid or gaseous phase, with ultraviolet light, if necessary in combination with hydrogen peroxide, or with ultraviolet, infrared and visible light in the form of what is called "Pulsed Light". However, completely sealed containers can not be sterilized in this way. Thus, when sterilizing package materials trials have recently been performed in order to utilize beta or gamma radiation for the deactivation and/or killing of microorganisms and viruses. Usually beta radiation (exposure to electrons) is preferred since this type of sterilization is less hazardous and not that costly to produce.

However, air (oxygen) is converted to ozone when exposed to electrons. Ozone is a strong oxidant for organic substances, and ozone present in containers in turn reacts with the inside of the package material, an undesired residual flavor being obtained from such reaction products. The formation of ozone thus results in a product limitation, i.e. it will be more difficult to pack sensitive products. Such products are in principle all those which contain water; the more water in the product the more off taste producing compounds are solubilized from the plastic material. The presence of a residual flavor in the product might be avoided by improving the quality of the plastic in the material. However, materials with good ozone resistance, such as for example polyurethane materials, are expensive and furthermore not always applicable as a package material for specific purposes.

It is known to irradiate the inside as well as the outside of a not yet sealed package material with an electron gun (electron accelerator). It is also known to sterilize a container which is ready to be filled by means of exposure to electrons, the package under rotation being exposed to an electron beam from a window of said electron gun. The energy of the electron beam is adapted in such a way that the electron beam all the time penetrates that wall of the container which is facing said window and reaches the opposite inside wall of the container. However, with this type of sterilizing completed containers the energy of the electron beam must at all times be adapted to the geometry of the container as well as the thickness of the package material, i.e. unless the container is not completely symmetric a uniform radiation dose will not be received on the inside of the container. This means that during the irradiation the energy either must be increased or varied, which in turn results in a more costly procedure and/or an altogether abundant use of energy. At the same time it is important that an overdose is not achieved which can result in impaired packaging properties and what is called "off-flavor".

BRIEF SUMMARY OF THE INVENTION

The purpose of the invention is to provide a method of the kind mentioned above, which in a cost-efficient way by means of exposure to electrons admits the sterilization of containers which are ready to be filled.

BRIEF DESCRIPTION OF THE SEVERAL VIEWS OF THE DRAWING

In order to explain the invention in more detail reference is made to the accompanying drawings in which FIG. 1 schematically shows a cross section through a container which is intended to be treated according to the method of the invention, FIG. 2 schematically shows the manufacture of such a container, and FIG. 3 according to one embodiment of the invention schematically shows a cross section through an electron accelerator and a conveyor with containers.

DETAILED DESCRIPTION OF THE INVENTION

Figure 1:
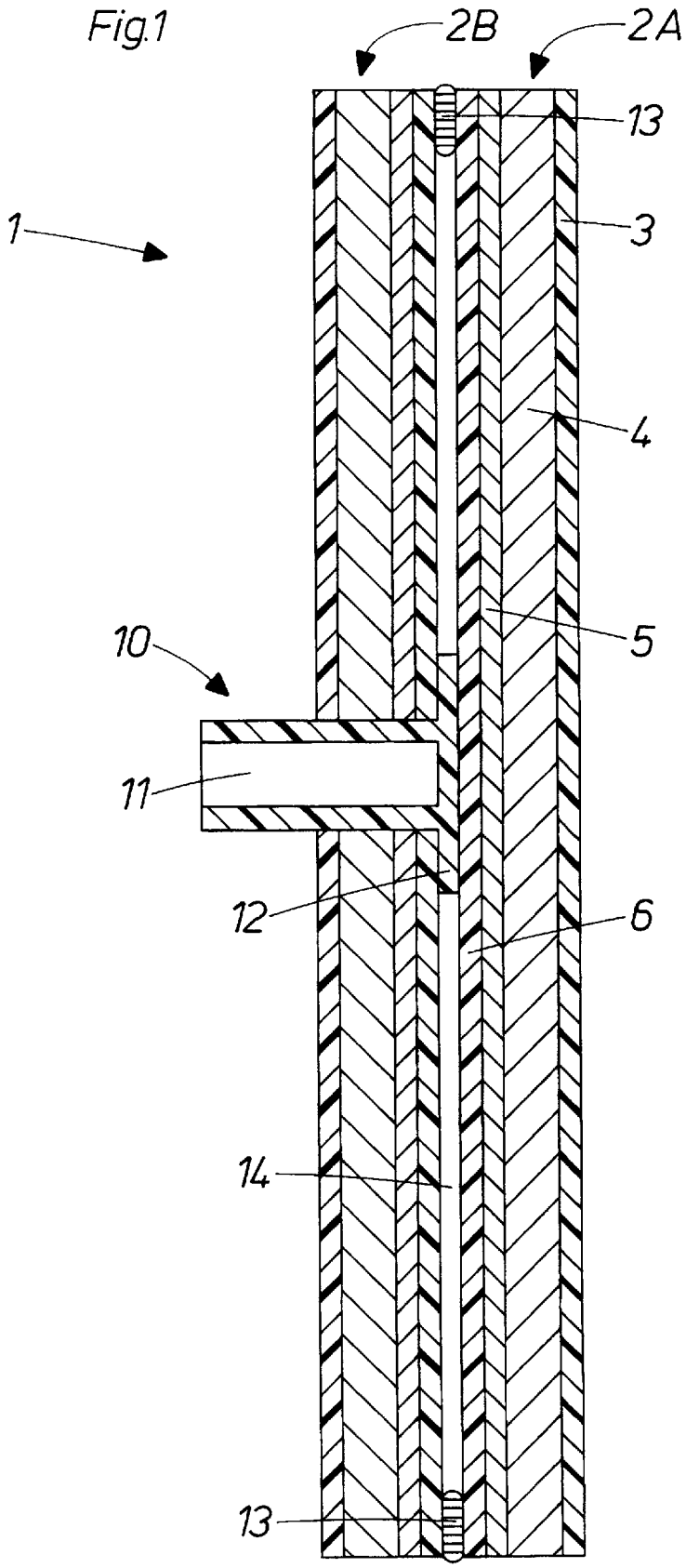

The method according to the invention can emanate from a package material which in order to form a packaging laminate can be based on fiber or plastic, laminated with different types of plastic and, if necessary, a light and/or oxygen gas barrier. In FIG. 1 an example is shown of a plane sealed container 1 constructed of two packaging halves of one and the same packaging laminate 2 which in the figure is shown as 2A and 2B. From the outside and inwards the laminate is preferably constructed of an outer layer 3 in the form of a polyethylene layer which typically is extruded onto a base layer 4 in an amount of 13 g/m$^2$. The base layer can be a fiber base, preferably of paper, or a plastic based layer. Inside the base layer 4 a barrier layer 5, e.g. a layer of aluminum foil, is arranged. An inner layer 6 is applied on the barrier layer 5 towards the contemplated inside of the container either in the form of two layers of extruded polyethylene or as a polyethylene film blown onto the barrier layer.

Figure 2:
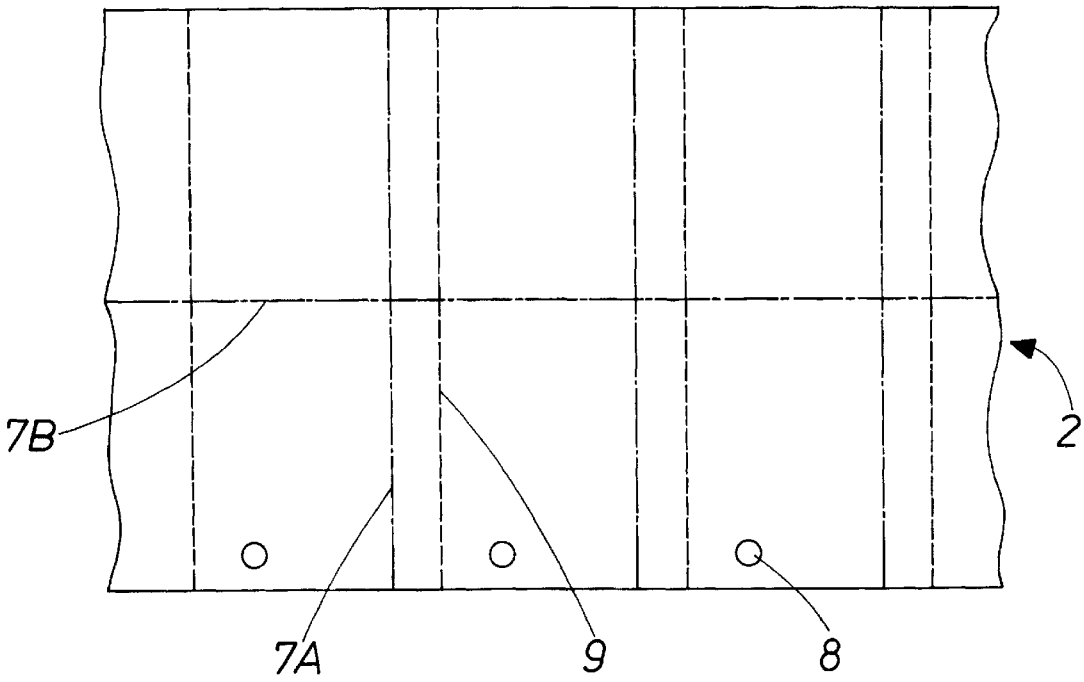

In order to be incorporated into the existing production the package material is arranged as whole rolls in the form of a flexible sheet or web material as is usual when liquid impermeable packaging containers with good dimensional rigidity are produced. Such packaging containers can for example be produced according to the following (FIG. 2). A package material is provided with a specific pattern of crease lines 7A, 7B in order to facilitate the conversion to packaging containers. The crease lines facilitate the folding of the material and run parallel with, perpendicular to, and transverse the longitudinal direction of the material, respectively. (Only a few lines are shown in the figure for the sake of simplicity). The demarcation surfaces of the container are defined by means of these crease lines.

In the fully laminated and pre-creased package material holes 8 are punched at suitable places for the intended use of the container, the material then being cut in pieces of suitable and intended size along the lines 9. A means 10 are put into each of these holes 8, this means 10 is preferably based on plastic and consists of a neck 11 (FIG. 1) provided with a flange 12 threaded onto the outside (not shown) in such a way that the flange 12 closely engages the inside of the container contemplated, i.e. the packaging laminate 2B. In this connection the neck 11 is constructed in such a way that the hole 8 is completely filled up. Then the package material is folded along the crease line 7B, and the flange 12 is sealed to the inner layers 6 of the corresponding two container halves of the packaging laminate 2, i.e. to the packaging laminate 2A as well. The inner layers 6 are completely pressed together in such a way that they almost entirely are engaged with each other. The three remaining longitudinal edges are then joined by means of longitudinal and transversal sealings 13. By this construction of the container no unprotected cut edges will be directed towards the inside of the container, and no paper fibers can thus be torn off and contact the inside of the container later on in the process.

With this procedure the distance between the inner layers will locally at the most correspond to a thickness of up to that of the flange 12 which is about 0.5 mm thick. Thus, the container is now so flat that very little or practically no air at all remains in the space 14 formed between the container halves by this procedure. This means that only a small amount of ozone can be formed and have an effect on the package material.

Thus, non-sterile folded and absolutely tight containers are obtained in this way, into which air with present micro-organisms or viruses—if any—can not penetrate. One container half will be substantially homogenous while the other half is provided with the neck 11 which on this side thus will protrude from the container. If the container is supposed to be provided with further elements these are according to the invention placed on the same side as the means 6, i.e. on or in the packaging laminate 2B. Such elements for the further usage of the container can be gripping devices for the handling of the container, relief prints, etc.

Figure 3:
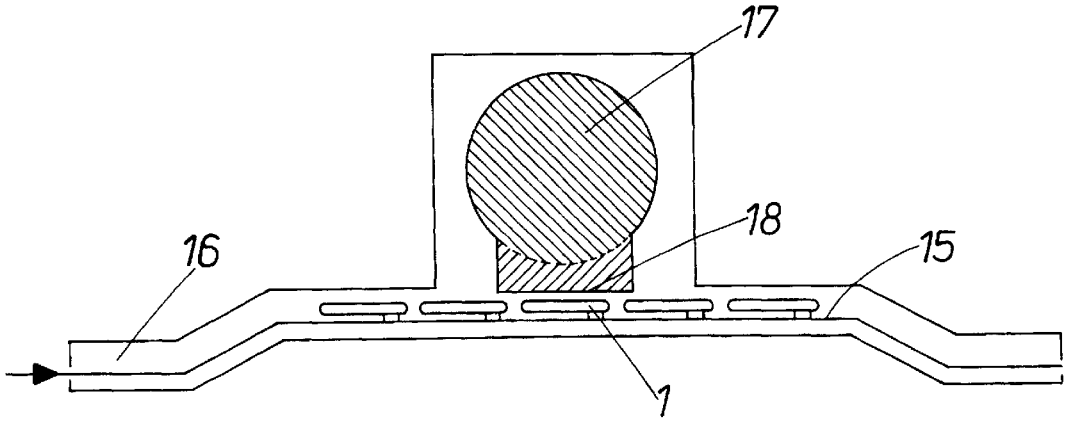

An example of how containers are sterilized according to the invention is shown in FIG. 3. Closed containers 1, pre-manufactured as above, are placed on a bed conveyer 15 or the like which via a radiation protected tunnel 16 moves them one by one beneath an electron gun 17 which via a window 18 from the outside exposes each container, preferably continuously straight through the package material to the opposite inside of the container. The electron gun is during this passage arranged above the one substantially half of the container with that side directed downwards which is provided with a neck. Thus, a sterilization is obtained from the top side of a homogenous and flat package material over its entire surface. This means that an absolutely even dose can be achieved through the same. The radiation dose absorbed at different points of the inner laminate of the container will thus be the same since the container is uniformly shaped until the radiation reaches the inner laminate. The radiation dose received by each container can in that respect be adjusted by controlling the process parameters. Thus, the penetration depth can be optimized for different types of containers.

The acceleration of the electrons in the electron gun is adapted in such a way that a sufficient radiation dose for sterilization is received on the inner laminates. That container half which is directed towards the electron gun is sterilized on the outside as well as on the inside while the other container half only absorbs a small radiation dose.

The penetration depth of the radiation dose mainly depends on its energy and the mass of the radiated material. In this connection the penetration depth is adjusted in such a way that an optimal dose for killing microorganisms is achieved in the space 14 and on the adjacent inner layers 6 of the two container halves 2A and 2B of the package laminate. Accordingly, a certain overdose is received in the upper half of the package material 2A while the underneath side of the laminate 2B provided with a neck hardly will receive any dose at all since the energy will decrease during the passage of the electrons through the package material. Thus, this container half receives a comparatively small radiation dose, which results in the mechanical properties not being effected in this container half with one or several elements for the further treatment of the container. This in turn can make a better what is called "package integrity" possible.

During the irradiation the energy of the electron gun is adapted to the grammage of the material for each type of container. The grammage of the package material can be very small and up to what is determined by the electron gun. A frequent occurring grammage for rigid package material is 250–750 g/m$^2$. The acceleration voltage of the electron gun can vary from 100 kV up to 500 kV in dependence of the package material.

A thicker base layer of for example paper can thus be used instead of what is commonly adopted within the art. This results in that larger container volumes can be obtained than with standard procedures when filling material is added. Preferably, containers are used with a volume of about 0.5 l up to about 4.5 l.

Internally sterile sealed containers can in a production unit advantageously be manufactured so that they later on can be distributed to different places in the world for filling in filling machines, in which the containers are opened, filled and sealed.

In a filling machine the neck 11 is sterilized with a chemical suitable for the purpose, preferably with hydrogen peroxide, UV light, or with combinations thereof. Remaining hydrogen peroxide—if any—is dried up, and the container is opened by cutting off the flange 12 by means of a punching operation through the neck 11. Since this middle piece of the flange is sealed to the opposite inside of the container it will not fall down into the product but remain on the container.

The punching operation can advantageously be accomplished by connecting a filling tube to the neck 11, the space 14 in the container then being operatively accessible, and the container is filled with a suitable aseptic or sterile product. The filling material in question is above all a liquid product such as milk, juice and tea, but the filling material can also contain particles. In connection with the filling the container forms itself by means of the filling pressure and with the assistance of the previously arranged crease lines in such a way that it preferably obtains a substantially rectangular bottom with substantially parallel sides. However, other embodiments are of course also possible.

By the flat design of the container and thus the small space 14 of the container none or very little ozone has been formed which can result in a residual flavor in the filled product. Nor is it necessary to ventilate any air from the container in connection with the filling. This considerably minimizes the risk of reinfection.

By the containers already being sterilized when filled the use is avoided of a what is called "an aseptic house", in which the containers enter via a sluice and which has to be completely sterile. This results in that a simpler machine design can be utilized, which in turn reduces the investment costs.

What is claimed is:

1. Method for sterilizing a preformed closed container (1) prior to filling said container with a food product wherein said container is made of folded sheet material comprising a homogenous flat first sheet (2A) and a non-homogenous second sheet (2B) with substantially planar inside walls and having a space (14) between the first and the second sheet, wherein interior surfaces of the container and the space (14) are sterilized by exposing outside surfaces of the first sheet (2A) of the container to electron radiation.

2. Method as claimed in claim 1, wherein the container is predesigned such that the space (14) is as small as possible.

3. Method as claimed in claim 1, wherein said second sheet (2B) is provided with means for the further treatment of the container.

4. Method as claimed in claim 3, wherein said means is a neck (11) for filling food product into the container.

* * * * *